US008387590B2

(12) United States Patent
Bolte et al.

(10) Patent No.: US 8,387,590 B2
(45) Date of Patent: Mar. 5, 2013

(54) RECIPROCATING-PISTON INTERNAL COMBUSTION ENGINE WITH ENGINE BRAKE AND ADDITIONAL OPENING OF AN EXHAUST VALVE

(75) Inventors: Frank Bolte, Melle (DE); Stefan Hubel, Mottingen (DE); Oliver Schnell, Veitsbronn (DE); Peter Sailer, Erlangen (DE); Franz Huschka, Hochstadt/aisch (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 422 days.

(21) Appl. No.: 12/739,806

(22) PCT Filed: Sep. 29, 2008

(86) PCT No.: PCT/EP2008/063031

§ 371 (c)(1),
(2), (4) Date: Apr. 26, 2010

(87) PCT Pub. No.: WO2009/053223

PCT Pub. Date: Apr. 30, 2009

(65) Prior Publication Data

US 2011/0232603 A1 Sep. 29, 2011

(30) Foreign Application Priority Data

Oct. 26, 2007 (DE) ..... 10 2007 051 302

(51) Int. Cl.
*F02D 13/04* (2006.01)

(52) U.S. Cl. ..... 123/321; 123/90.16

(58) Field of Classification Search ..... 123/321, 123/322, 90.16, 90.22, 90.43, 90.46, 90.55
See application file for complete search history.

(56) References Cited

U.S. PATENT DOCUMENTS

| | | | | |
|---|---|---|---|---|
| 3,859,970 | A | 1/1975 | Dreisin | |
| 5,704,319 | A * | 1/1998 | Engelhardt et al. | 123/90.55 |
| 5,860,399 | A * | 1/1999 | Speil et al. | 123/90.57 |
| 5,954,020 | A * | 9/1999 | Schmidt et al. | 123/90.48 |
| 5,992,360 | A * | 11/1999 | Elendt et al. | 123/90.16 |
| 6,119,644 | A * | 9/2000 | Speil | 123/90.55 |

(Continued)

FOREIGN PATENT DOCUMENTS

| | | |
|---|---|---|
| DE | 3904497 | 2/1990 |
| DE | 19604866 | 8/1997 |

(Continued)

*Primary Examiner* — John Kwon
(74) *Attorney, Agent, or Firm* — Volpe and Koenig, P.C.

(57) ABSTRACT

A four-stroke internal combustion engine, having a brake controller by which pressure is built up in the exhaust system and/or at least one exhaust valve is additionally opened is provided. A hydraulic valve clearance compensation element is incorporated in at least one transmission element between the camshaft and at least one intake and exhaust valve and has at least one piston (3), a cylinder housing part (2) that interacts with the piston (3), a return spring (16) disposed therebetween, a check valve (4), and an actuatable locking device is provided which limits the movement of the piston (3) relative to the cylinder housing part (2) and/or limits the movement of the cylinder housing part (2) relative to an exterior housing (1) connected to one of the transmission elements or relative to a transmission element at least in one direction of movement, and the piston (3) is supported on a stop element (5) connected to the exterior housing (1) or the transmission element.

16 Claims, 3 Drawing Sheets

U.S. PATENT DOCUMENTS

| | | | | |
|---|---|---|---|---|
| 6,718,923 | B2 * | 4/2004 | Barth et al. | 123/90.55 |
| 7,921,823 | B2 * | 4/2011 | Sailer et al. | 123/90.55 |
| 2003/0098000 | A1 | 5/2003 | Vorih et al. | |

FOREIGN PATENT DOCUMENTS

| | | |
|---|---|---|
| DE | 19838926 | 3/2000 |
| EP | 0285877 | 3/1988 |
| EP | 0974740 | 1/2000 |
| EP | 1149989 | 10/2001 |
| EP | 1411214 | 4/2004 |
| WO | 03087544 | 10/2003 |

* cited by examiner

RECIPROCATING-PISTON INTERNAL COMBUSTION ENGINE WITH ENGINE BRAKE AND ADDITIONAL OPENING OF AN EXHAUST VALVE

BACKGROUND

The invention relates to a four-stroke internal combustion engine with a crankcase and at least one cylinder arranged in this crankcase and in which a working piston is guided by a crankshaft, with at least one cylinder head that closes the cylinder and whose intake and exhaust ports are managed by at least one intake valve and exhaust valve loaded with a closing spring, wherein these valves can be activated by transmission elements driven by the camshaft, and with a brake control device by which pressure is built up in the exhaust system, in particular, in the exhaust channels, and/or an additional opening of at least one exhaust valve.

Such a class-forming internal combustion engine is generally known. Known are, furthermore, several systems for engine-brake controlling.

One system includes an exhaust-gas choke that is arranged in the exhaust-gas system of the internal combustion engine. Here, the engine must work against the increased pressure in the exhaust-gas system and thus generates braking power.

A different system, disclosed in DE-39 04 497 C1, has a decompression device. In this system, before the end of the compression cycle, the exhaust valve is opened and thus the generated pressure in the combustion chamber is released. Therefore, the energy for the subsequent depressurization cycle is no longer returned to the engine and a braking effect is generated.

It is furthermore known, from EP-0 974 740 A2, to keep open one of the exhaust valves during the braking process, in order to hold it open a small amount, so that continuous decompression with corresponding braking effect is realized.

It has been shown that hydraulic valve clearance compensation elements, also called "HVA" in the present patent application, do not function or do not function satisfactorily in connection with braking devices, because there is the risk, e.g., that the "HVA" makes an undesired adjustment during the braking operation.

SUMMARY

Therefore, the object of the invention is to modify a hydraulic valve clearance compensation element so that it is suitable for installation in the valve drive of internal combustion engines with engine brake devices. Here, the "HVA" should be designed so that it does not generate an adjustment also in connection with an engine brake controller. It should be in the position to guarantee a reliably operating function under all conditions.

The objective of the invention is met in that a hydraulic valve clearance compensation element is installed in at least one of the transmission elements between the camshaft and at least one intake and/or exhaust valve that has at least one piston, a cylinder housing part interacting with the piston, a return spring installed in-between, and a check valve, and a locking device that can be activated is provided that limits the movement of the piston relative to the cylinder housing part and/or of the cylinder housing part relative to an outer housing connected to the transmission elements or a transmission element at least in one direction of movement, and the piston is supported on a stop body that is connected to the outer housing or the transmission element. Through this construction it is achieved that during the engine brake operation, the HVA function is maintained, but the HVA cannot be adjusted past the movement limit. Therefore, the pumping of the HVA is prevented, although the exhaust valve or valves are partially opened in the engine brake operation and the transmission elements are at least partially depressurized. During the locking limit, the HVA can fade under loading and during depressurization can be adjusted within the limited region, wherein when leaving the braking operation, the HVA again compensates the maximum possible fading path.

In another construction of the invention it is provided that the locking device that can be activated has a clamping sleeve that is arranged between the cylinder housing part and the outer housing or the transmission element, and the clamping sleeve forms a stop with the outer housing or the transmission element, and the clamping sleeve can be fixed relative to the cylinder housing part.

According to an alternative construction of the invention it is provided that the locking device that can be activated has a clamping sleeve that is arranged between the stop body and the outer housing or the transmission element, the clamping sleeve forms a stop with the cylinder housing, and the clamping sleeve can be fixed relative to the stop body.

In this way it is achieved that the cylinder housing part does not continue to pump for an open exhaust valve, that is, for an at least partial depressurization of the transmission elements. In this way, because the locking device can be locked at an arbitrary point, the position of the stop is variable and adapts to the working position of the HVA. Therefore, in the position in which it is located at the beginning of the engine brake control, a stop is allocated to the HVA and thus limits the movement in one direction.

Advantageously, the stop can have a spring ring that is arranged in a recess of the clamping sleeve or in a recess of the cylinder housing part and is in active connection with a support surface on the outer housing or on the transmission element or with a support surface on the clamping sleeve. In these features, both constructions are integrated and comprise both the version in which the clamping sleeve is arranged around the cylinder housing part and also the version in which the clamping sleeve is arranged essentially around the stop body and the stop is arranged between the clamping sleeve and the cylinder housing part.

In the construction in which the clamping sleeve is arranged around the cylinder housing part, a clamping sleeve spring is installed that is constructed as a compression spring and that is supported on one side on the clamping sleeve and on the other side on the stop body that is formed in this case as a stop plate.

In the construction in which the clamping sleeve is arranged around the stop body, the clamping sleeve spring is arranged so that it is supported on one side on the clamping sleeve and on the other side on the outer housing or on the transmission element.

The locking device contains at least one clamping body that is supported so that it can move in the cylinder housing part or in the alternative construction in the stop body, wherein the clamping body is loaded on one side by a spring and can be loaded on the other side by a pressurized fluid and wherein the clamping sleeve can be fixed by the clamping body relative to the stop body or the cylinder housing part. In this way it is achieved that at the beginning of the engine brake control the at least one clamping body is pressed by a spring or pressurized fluid against the clamping sleeve and thus the clamping sleeve is fixed accordingly.

Advantageously, teeth, grooves, or the like or other types of roughened sections adapted to each other are provided to the clamping body on its surface facing the clamping sleeve and to the clamping sleeve on its surface facing the clamping body, so that the clamping sleeve can be clearly fixed. Obviously, the teeth, grooves, or the like on the clamping sleeve have a longer extent in the adjustment direction of the HVA, so that the clamping sleeve can be fixed in all of the possible operating positions at the beginning of the engine brake control.

In connection with the construction in which the clamping sleeve is arranged around the cylinder housing part, it is provided that at least two clamping bodies are provided that are supported against each other by a clamping body spring and that the clamping sleeve has, in its wall, in the region of the clamping body, openings that can be connected controllably to a pressurized fluid source. In this construction, in normal operation of the HVA, pressurized fluid is provided by the openings and the clamping body is compressed against the force of the clamping body spring, so that the HVA can work without limitation. At the beginning of the braking operation, when the pumping of the HVA is to be limited, the connection of the openings to the pressurized fluid source is interrupted and the openings are depressurized, so that the clamping body spring presses the clamping body in the direction of the clamping sleeve and the teeth engage in each other, so that the stop is active.

So that the openings of the clamping bodies are adapted, the clamping sleeve is locked in rotation relative to the cylinder housing part. The rotational locking can be realized by an alignment pin that is arranged in the clamping body and that is in active connection with a longitudinal groove in the cylinder housing part.

Furthermore, it is provided that the facing surfaces of the clamping body are in active connection with an adjustment pin that is arranged in the cylinder housing part. The adjustment pin is advantageously formed similarly as a fitted key, so that it simultaneously causes a ventilation of the inner space between the clamping bodies in which is arranged advantageously the clamping body spring.

According to the alternative construction in which the clamping sleeve is arranged around the stop body, it is provided that there are at least two clamping bodies that are loaded against each other by a tension spring and that, in the region of the facing surfaces of the clamping bodies, a borehole is provided in the stop body, wherein this borehole can be connected controllably to a pressurized fluid source. In this construction, the clamping bodies are held together by the tension spring and brought with the clamping sleeve out from the active connection, so that the HVA can operate in the normal state. At the beginning of the brake control, when the HVA is to be limited, pressurized fluid is fed via the borehole between the clamping bodies, so that these engage with their teeth in the teeth of the clamping sleeve and the stop becomes active.

Advantageously, the tension spring is formed as a tubular spring that is arranged in grooves in the surfaces of the clamping body facing the clamping sleeve. Advantageously the stop body then also obtains grooves, so that the tubular spring can be placed like a ring around the stop body and the clamping body. Between the facing surfaces of the clamping bodies, a spring ring is inserted in the stop body, wherein this spring ring is arranged in an extension of the borehole, so that, on one hand, pressurized fluid can always reach between the clamping bodies and, on the other hand, these can have an inner stop.

BRIEF DESCRIPTION OF THE DRAWINGS

For further explanation of the invention, refer to the drawings in which embodiments of the invention are shown simplified. Shown are.

DETAILED DESCRIPTION OF THE PREFERRED EMBODIMENTS

Figure 1:
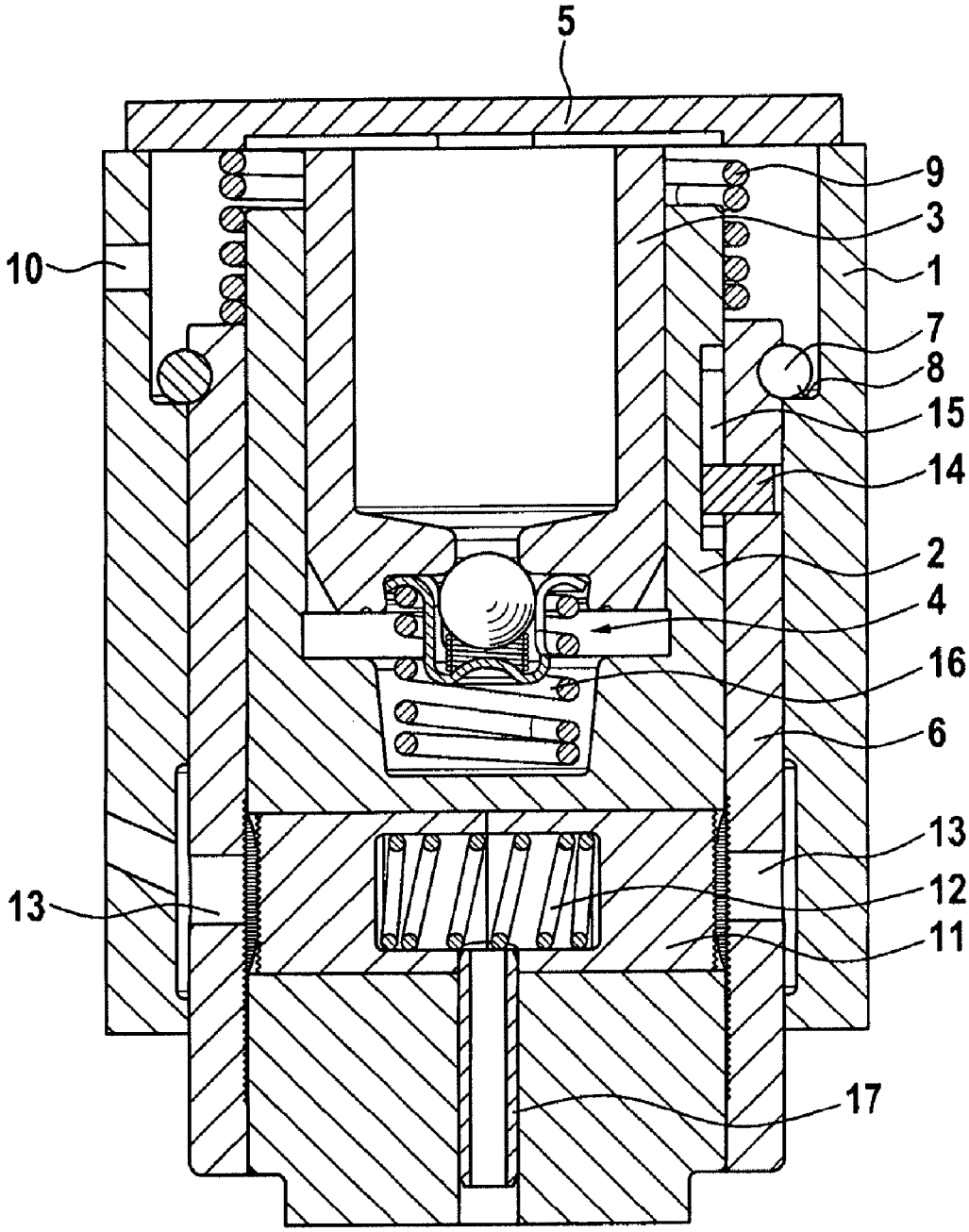
FIG. 1: a section through a hydraulic valve clearance compensation element with locking device in which the clamping between cylinder housing part and clamping sleeve is realized, in freely moving position.
Figure 2:
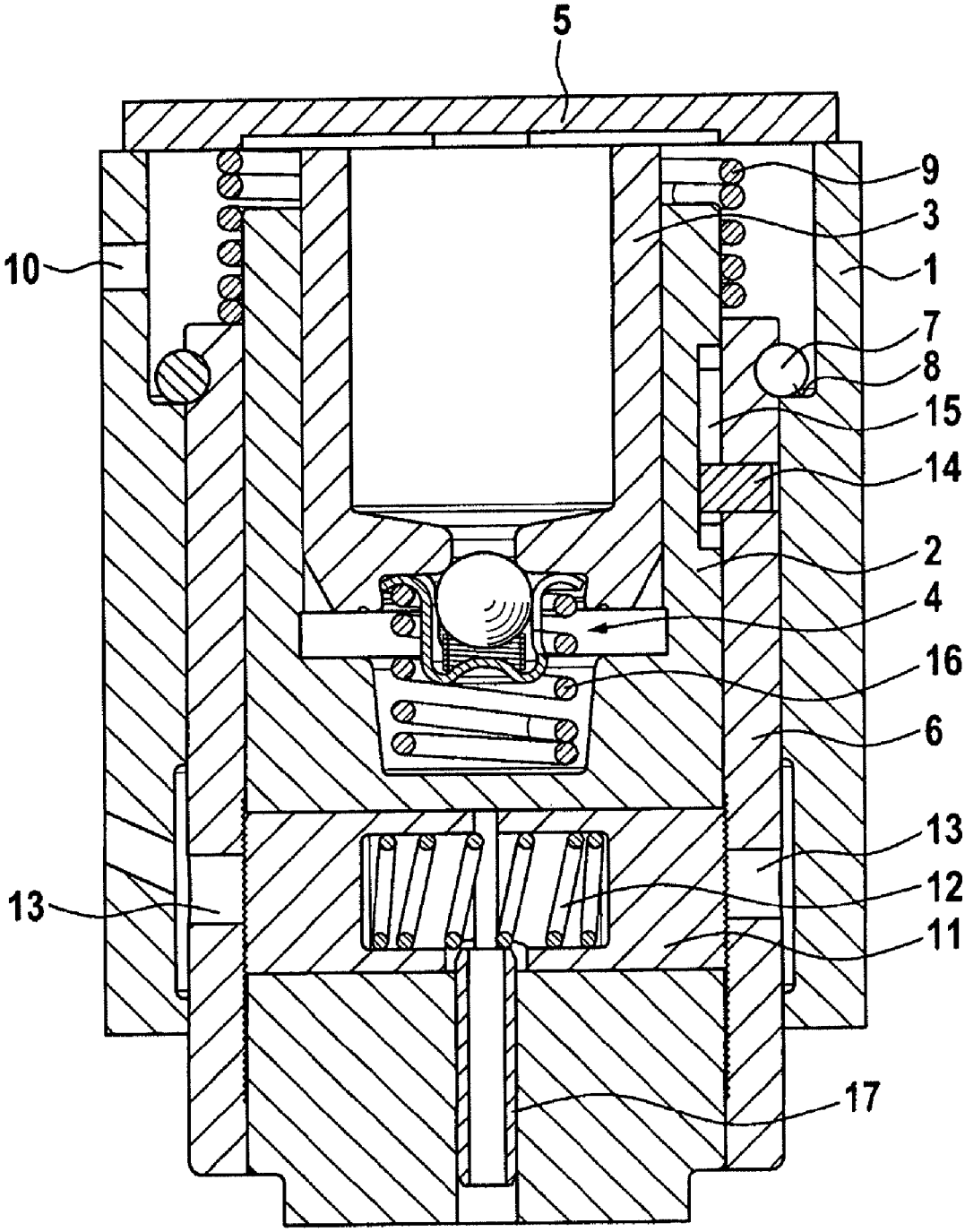
FIG. 2: a section through the HVA according to FIG. 1 in locking position.
Figure 3:
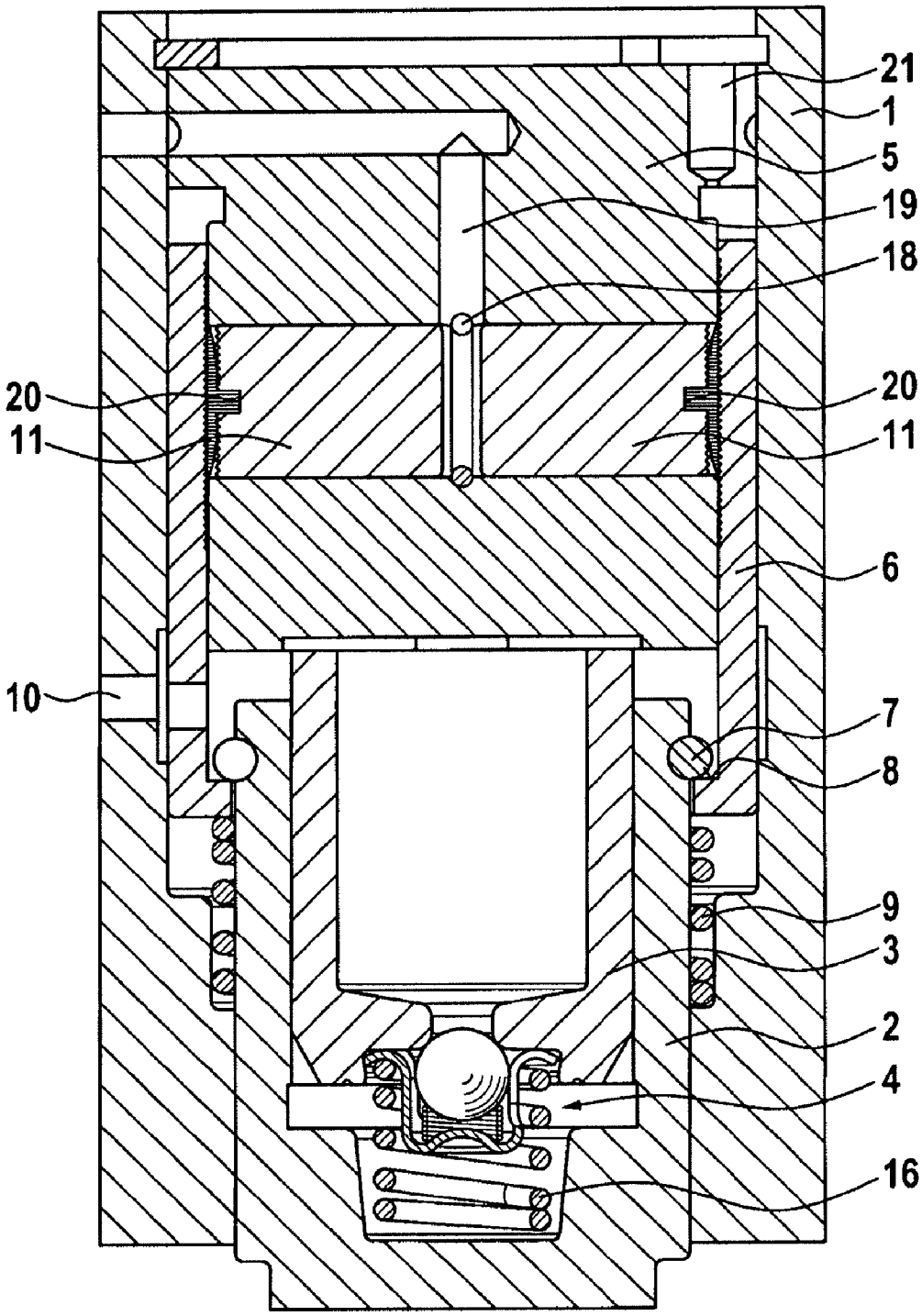
FIG. 3: a section through a hydraulic valve clearance compensation element with a locking device and locking between the stop body and clamping sleeve, in freely moving position.

In FIGS. 1 to 3, as far as shown in detail, an outer housing is designated with 1 that can be installed in a rocker arm, in a cam follower/finger lever, a tappet, a bridge between two valves, or in a different transmission element between the camshaft and intake and/or exhaust valve. The outer housing 1 can also be formed, however, as a part of one of these components or integrally with one of these components. The outer housing 1 has an inner opening in which a cylinder housing part 2 is installed that has a pot-shaped construction. In the cylinder housing part 2, a piston 3 is guided that forms, with the cylinder housing part 2, a high-pressure oil chamber to which a central borehole in the piston is connected that can be closed by a check valve designated with 4. In the high-pressure oil chamber or an extension of this chamber, a return spring designated with 16 is installed that exerts a compressive force on the piston 3 and the cylinder housing part 2.

In the embodiment according to FIGS. 1 and 2, one end of the outer housing 1 is closed by a stop body 5 that is constructed in this embodiment as a stop plate. The piston 3 can be supported on the stop plate. Around the cylinder housing part 2 and within the outer housing 1, a clamping sleeve 6 is installed that has, on its end facing the stop plate, a recess in which a spring ring 7 is inserted that is in active connection with a support surface 8 on the stop body 1. Between the clamping sleeve 6 and the stop body 5 formed as the stop plate, a clamping sleeve spring 9 is installed that is formed as a compression spring and that presses the clamping sleeve against the support surface 8. At the height of the clamping sleeve spring 9, an oil supply borehole 10 is formed in the outer housing 1, and the borehole is connected by grooves in the stop plate with the inner space of the piston 3. This provides the oil supply for the HVA.

In the cylinder housing part 2, two clamping bodies 11 are installed underneath the piston 3 and guided so that they can move in the radial direction. Between the clamping bodies 11, a clamping body spring designated with 12 is installed that is constructed as a compression spring and loads the clamping bodies outward in the radial direction. The clamping bodies 11 have teeth on their surfaces facing the clamping sleeve 6, wherein these teeth are complementary to corresponding teeth on the inner surface of the clamping sleeve. The teeth region on the inner surface of the clamping sleeve is extended in the longitudinal direction of the HVA across the clamping bodies, so that the teeth engagement between the clamping bodies and clamping sleeve can be realized at arbitrary positions of the HVA. In the region of the clamping body end faces, openings 13 are machined into the clamping sleeve 6, wherein these openings are in active connection with an annular recess in the outer housing 1 and wherein a not-shown pressurized oil source is connected to the annular recess.

As shown in the embodiment according to FIG. 1, the teeth of the clamping bodies are shifted inward out from the region of the teeth of the clamping sleeve 6, so that there is no engagement. The HVA can work without limitation. This was realized in that the pressure of the pressurized fluid in the openings 13 is greater than the force of the clamping body spring 12, so that this is compressed. In the clamping sleeve 6, furthermore, an alignment pin 14 is installed that is in active connection with a longitudinal groove 15 in the cylinder housing part 2, so that protection against twisting between the clamping sleeve 6 and cylinder housing part 2 is provided. In the cylinder housing part 2, an adjustment pin 17 is further installed that reaches with its end into openings of the clamping bodies 11 and thus fixes the position of the clamping bodies. It is simultaneously used as protection against twisting of the clamping bodies 11. The adjustment pin 17 has a hollow construction, so that ventilation of the space of the clamping body spring 12 can be realized by the adjustment pin.

In the embodiment according to FIG. 2, the openings 13 are depressurized, so that the clamping body spring 12 presses the clamping bodies 11 outward and locking between the cylinder housing part 2 and clamping sleeve 6 is realized.

In the embodiment according to FIG. 3, the clamping sleeve 6 is arranged between the outer housing 1 and stop body 5, the support surface 8 is provided on the clamping sleeve 6, and the spring ring 7 is inserted into a recess of the cylinder housing part 2. Furthermore, the clamping sleeve spring 9 is also supported relative to the clamping sleeve 6 on a surface of the outer housing 1. The oil supply for the HVA is provided by an oil supply borehole 10 in the outer housing 1 and an annular recess in the outer housing 1, as well as a borehole in the clamping sleeve 6 and grooves in the stop body 5. The stop body 5 is formed in this embodiment like a piston and holds the clamping bodies 11. Between the inner surfaces of the clamping bodies 11, a spring ring designated with 18 is inserted in the stop body 5, and the spring ring represents a stop for the two clamping bodies 11 and simultaneously creates space so that pressurized fluid can reach between the clamping bodies 11 that can be fed from a pressurized oil source through a central borehole 19 in the stop body 5.

Grooves 20 are machined into the surfaces of the clamping bodies 11 facing the clamping sleeve 6, wherein, not shown, a tubular spring formed as a tension spring is inserted into these grooves. This tubular spring presses the clamping bodies 11 together, so that these are not in active connection with the teeth of the clamping sleeve 6, as shown in FIG. 3, and the HVA can move freely. If pressurized fluid is supplied via the borehole 19, then this moves the clamping bodies 11 outward, wherein the teeth come into engagement and the clamping sleeve 6 is fixed relative to the stop body 5. In order to ventilate the space between the clamping sleeve 6, the outer housing 1, and the stop body 5, a ventilation borehole designated with 21 is formed in the stop body, so that the clamping sleeve 6 can move freely in the non-locking position by the clamping sleeve spring 9.

LIST OF REFERENCE SYMBOLS

1 Outer housing
2 Cylinder housing part
3 Piston
4 Check valve
5 Stop body
6 Clamping sleeve
7 Spring ring
8 Support face
9 Clamping sleeve spring
10 Oil supply borehole
11 Clamping body
12 Clamping body spring
13 Openings
14 Alignment pin
15 Longitudinal groove
16 Return spring
17 Adjustment pin
18 Spring ring
19 Borehole
20 Grooves
21 Ventilation borehole

The invention claimed is:

1. A four-stroke internal combustion engine comprising a crankcase and at least one cylinder that is arranged in the crankcase and in which a working piston is guided by a crankshaft, at least one cylinder head closes the cylinder and includes intake and exhaust channels that are controlled by at least one intake valve and at least one exhaust valve that are each loaded with a closing spring and the at least one intake valve and the at least one exhaust valve are activated by transmission elements driven by a camshaft, and a brake control device by which pressure is built up in an exhaust system in the exhaust channels, and an opening of the at least one exhaust valve is performed, a hydraulic valve clearance compensation element is installed in at least one of the transmission elements between the camshaft and the at least one intake valve and the at least one exhaust valve, wherein the compensation element has at least one piston, a cylinder housing part interacting with the at least one piston, a return spring installed there-between, and a check valve, a locking device is provided that is activated and that limits movement of the at least one piston relative to the cylinder housing part and of the cylinder housing part relative to an outer housing connected to one of the transmission elements at least in one direction of motion, and the at least one piston is supported on a stop body that is connected to the outer housing or the transmission element.

2. Internal combustion engine according to claim 1, wherein the locking device has a stop that limits adjustment movement of the hydraulic valve clearance compensation element.

3. Internal combustion engine according to claim 2, wherein activation and deactivation of the locking device is performed by pressurized fluid and a spring force.

4. Internal combustion engine according to claim 1, wherein the locking device has a clamping sleeve that is arranged between the cylinder housing part and the outer housing or the transmission element, the clamping sleeve forms a stop with the outer housing or the transmission element, and the clamping sleeve is fixed relative to the cylinder housing part.

5. Internal combustion engine according to claim 1, wherein the locking device has a clamping sleeve that is arranged between the stop body and the outer housing or the transmission element, the clamping sleeve forms a stop with the cylinder housing part, and the clamping sleeve is fixed relative to the stop body.

6. Internal combustion engine according to claim 4, wherein the stop has a spring ring that is arranged in a recess of the clamping sleeve or the cylinder housing part and is in active connection with a support surface on the outer housing, or on the transmission element, or a support surface on the clamping sleeve.

7. Internal combustion engine according to claim 4, wherein a clamping sleeve spring is installed that is constructed as a compression spring and is supported on one side on the clamping sleeve and on the other side on the stop body, or outer housing, or on the transmission element.

8. Internal combustion engine according to claim 4, wherein at least one clamping body is supported in the cylinder housing part or in the stop body so that the at least one clamping body can move, wherein the at least one clamping body is loaded on one side by a clamping body spring and is loaded on the other side by pressurized fluid, and the clamping sleeve is fixed by the clamping body relative to the stop body or the cylinder housing part.

9. Internal combustion engine according to claim 8, wherein teeth or grooves that are complementary to each other are provided on the at least one clamping body on a surface facing the clamping sleeve and on the clamping sleeve on a surface facing the at least one clamping body.

10. Internal combustion engine according to claim 8, wherein at least two clamping bodies are provided that are supported against each other by a clamping body spring and the clamping sleeve has, in a wall in a region of the clamping body, openings that are connected controllably to a pressurized fluid source.

11. Internal combustion engine according to claim 8, wherein the clamping sleeve is locked in rotation relative to the cylinder housing part.

12. Internal combustion engine according to claim 11, wherein the rotational locking is realized by an alignment pin that is inserted into the clamping sleeve and that is in active connection with a longitudinal groove in the cylinder housing part.

13. Internal combustion engine according to claim 8, wherein facing surfaces of at least two clamping bodies are in active connection with an adjustment pin that is arranged in the cylinder housing part.

14. Internal combustion engine according to claim 8, wherein at least two clamping bodies are provided that are loaded against each other by a tension spring and, in a region of facing surfaces of the at least two clamping bodies, a borehole is provided in the stop body that is connected controllably to a pressurized fluid source.

15. Internal combustion engine according to claim 14, wherein the tension spring is constructed as a tubular spring that is arranged in grooves in surfaces of the at least two clamping bodies facing the clamping sleeve.

16. Internal combustion engine according to claim 14, wherein a spring ring is inserted in the stop body between the facing surfaces of the at least two clamping bodies.

* * * * *